US006735920B1

(12) United States Patent
Cadogan

(10) Patent No.: US 6,735,920 B1
(45) Date of Patent: May 18, 2004

(54) DEPLOYABLE SPACE FRAME AND METHOD OF DEPLOYMENT THEREFOR

(75) Inventor: David P. Cadogan, Middletown, DE (US)

(73) Assignee: ILC Dover, Inc., Frederica, DE (US)

( * ) Notice: Subject to any disclaimer, the term of this patent is extended or adjusted under 35 U.S.C. 154(b) by 0 days.

(21) Appl. No.: 09/937,763

(22) PCT Filed: Mar. 23, 2000

(86) PCT No.: PCT/US00/07706

§ 371 (c)(1),
(2), (4) Date: Oct. 1, 2001

(87) PCT Pub. No.: WO01/71126

PCT Pub. Date: Sep. 27, 2001

(51) Int. Cl.[7] ..... E04B 1/35; E04H 12/00

(52) U.S. Cl. ..... 52/741.1; 52/2.11; 52/2.18; 52/108; 52/646

(58) Field of Search ..... 52/2.11, 2.12, 52/2.18, 641, 645, 646, 652.1, 653.2, 655.2, DIG. 13, 108, 741.1, 745.17; 343/915

(56) References Cited

U.S. PATENT DOCUMENTS 4,480,415 A * 11/1984 Truss ..... 52/108
4,532,742 A * 8/1985 Miura ..... 52/108
4,662,130 A * 5/1987 Miura et al. ..... 52/108
5,311,706 A * 5/1994 Sallee ..... 52/2.18
5,579,609 A * 12/1996 Sallee ..... 52/2.11
5,630,296 A 5/1997 Kendall, Jr.
5,669,086 A * 9/1997 Garman ..... 5/86.1
5,706,846 A 1/1998 Sutton
5,909,197 A * 6/1999 Heinemann et al. ..... 343/895
6,092,249 A * 7/2000 Kamen et al. ..... 5/653
6,433,758 B2 * 8/2002 Meguro et al. ..... 343/915

* cited by examiner

*Primary Examiner*—Robert Canfield
(74) *Attorney, Agent, or Firm*—Stevens, Davis, Miller & Mosher, L.L.P.

(57) ABSTRACT

A space frame (100) capable of facilitating the deployment, and subsequent support, of a space structure includes a packageable, deployable, and rigidizable frame assembly (110), a packageable, deployable, and inflatable frame assembly shell (120) disposed around the frame assembly (110); means for attaching the frame assembly shell (120) to the frame assembly (10); and a shell inflator. The method of packaging and deploying the space frame (100) includes (a) collapsing the frame assembly (110) by packaging the shell (120) to provide a packaged frame assembly/shell; (b) controllably deploying the frame assembly (110) and the shell (120) from the packaged frame assembly/shell by employing the shell inflator to inflate the shell (120) while imparting a resistance to the shell (120) to resist deployment such that the internal gas pressure required to continue deployment is sufficient to fully inflate that portion of the shell (120) to which gas has been introduced; (c) continuing to resist deployment until the frame assembly (110) and the shell (120) are deployed; (d) terminating the introduction of gas into the shell (120); (e) rigidizing the frame assembly (110); (f) depressurizing the shell (120).

4 Claims, 1 Drawing Sheet

DEPLOYABLE SPACE FRAME AND METHOD OF DEPLOYMENT THEREFOR

CROSS-REFERENCE TO RELATED APPLICATIONS

This application is a 371 application of International Application No. PCT/US00/07706, filed Mar. 23, 2000, the entire disclosures of which are incorporated herein by reference.

BACKGROUND OF THE INVENTION

1. Field of the Invention

This invention relates generally to a method and an apparatus capable of deploying and subsequently supporting a lightweight space structure such as a solar array, reflector, sunshield, radar array, antenna, or concentrator. The invention relates more specifically to a method and lightweight apparatus that provide for the controlled deployment of an inflatable shell containing a space frame assembly, and the subsequent rigidization of the assembly so as to support the space structure.

2. Description of Related Art

Most conventional methods for deploying and supporting a space structure accomplish the deployment by means of deployable truss structures consisting of relatively heavy elements such as rigid members, hinges, latches, and cables. Increases in the number of satellites to be launched over the next several decades, however, will emphasize the need for the reduction of space hardware mass, stowage volume, and cost.

One approach to realizing these reductions is through the use of inflatable, deployable, space structures. Inflatable structures offer many benefits over conventional deployable structures because they are lower in mass and can be packaged into small volumes, which reduces launch vehicle size and cost. The performance benefit margin of inflatable structures increases as the size of the structure increases, thus making the technology more attractive for large-scale systems. Examples of satellite components that benefit from the utilization of inflatable structures include solar arrays, communications antennas, radar antennas, thermal/light shields, and solar sails.

Although inflatable tubular structures weigh less than deployable truss structures consisting of elements such as rigid members, hinges, latches, and cables, the weight of the inflatable tubular structures is not insignificant.

Therefore, a need exists for a method and an apparatus capable of facilitating the deployment, and subsequent support, of a space structure, but which can do so with an overall apparatus weight which is less than that of conventional inflatable deployment structures.

SUMMARY OF THE INVENTION

It is an object of the present invention to provide a method and an apparatus capable of deploying and subsequently supporting a space structure. It is a further object of the present invention to provide a method and an apparatus capable of facilitating the deployment by controlling both the rate and the directionality of deployment. It is a still further object of the present invention to provide a method and an apparatus capable of facilitating the deployment, and subsequent support, of the space structure, but which can do so with an overall apparatus weight which is less than that of conventional inflatable deployment structures.

Accordingly, the present invention is directed to a deployable space frame comprising a packageable, deployable, and rigidizable frame assembly; a packageable, deployable, and inflatable frame assembly shell disposed around the frame assembly; means for attaching the frame assembly shell to the fame assembly; and a shell inflator.

The present invention is also directed to a method of packaging and deploying the space frame. The method comprises (a) collapsing the frame assembly by packaging the shell to provide a packaged frame assembly/shell; (b) controllably deploying the frame assembly and the shell from the packaged frame assembly/shell by employing the shell inflator to inflate the shell while imparting a resistance to the shell to resist deployment such that the internal gas pressure required to continue deployment is sufficient to fully inflate that portion of the shell to which gas has been introduced; (c) continuing to resist deployment until the frame assembly and the shell are deployed; (d) terminating the introduction of gas into the shell; (e) rigidizing the frame assembly; and (f) depressurizing the shell.

Thus, as the shell inflates, it deploys both the shell and the frame assembly contained therein in a controlled manner. Once the deployed shell is fully inflated, the frame assembly is rigidized to provide the support for the space structure. The shell is then depressurized and assumes an essentially passive role, apart from providing environmental protection for the rigidized frame assembly.

The advantages associated with the present invention are numerous. First, as indicated above, most conventional methods for deploying and supporting a space structure accomplish these tasks by means of either deployable truss structures consisting of relatively heavy elements, or inflatable structures. The space frame, however, requires substantially less material to accomplish the same structural performance as conventional inflatable structures, and is therefore lower in mass. The present invention, therefore, provides a lightweight means for both deploying and supporting a variety of space structures. Furthermore, by virtue of its inflatable means for deployment and rigidizable means for support, the invention comprises a lighter-weight system with fewer moving parts, thereby providing a higher degree of system reliability. Finally, the ability to collapse the structure for launch results in a packed volume which is minimal when compared with the aforementioned conventional structures.

Thus, while specifically facilitating as its primary application the deployment of lightweight space structures, the invention also more generally provides for the deployment of any lightweight structure that can then be maintained in place by the rigidity of the frame assembly.

BRIEF DESCRIPTION OF THE DRAWINGS

Other objects, features, and advantages of the present invention will become more fully apparent from the following detailed description of the preferred embodiments, the appended claims, and the accompanying drawings. As depicted in the attached drawings:

DESCRIPTION OF THE PREFERRED EMBODIMENTS

The present invention will be disclosed in terms of the currently perceived preferred embodiments thereof.

The deployable space frame is an ultra-lightweight structural member that is simple to manufacture and readily tailorable to meet the structural requirements of a specific application. The space frame comprises a truss beam that comprises a series of connected box frames, or bays, manufactured from low-mass rigidizable composite tubes, enveloped within an inflatable outer shell. The deployable space frame requires substantially less material to accomplish the same structural performance as conventional cylindrical inflatable tube structures, and is therefore lower in mass. Furthermore, the deployed beam becomes a rigid structural member that does not require the support of inflation pressure to maintain its shape.

Figure 1:
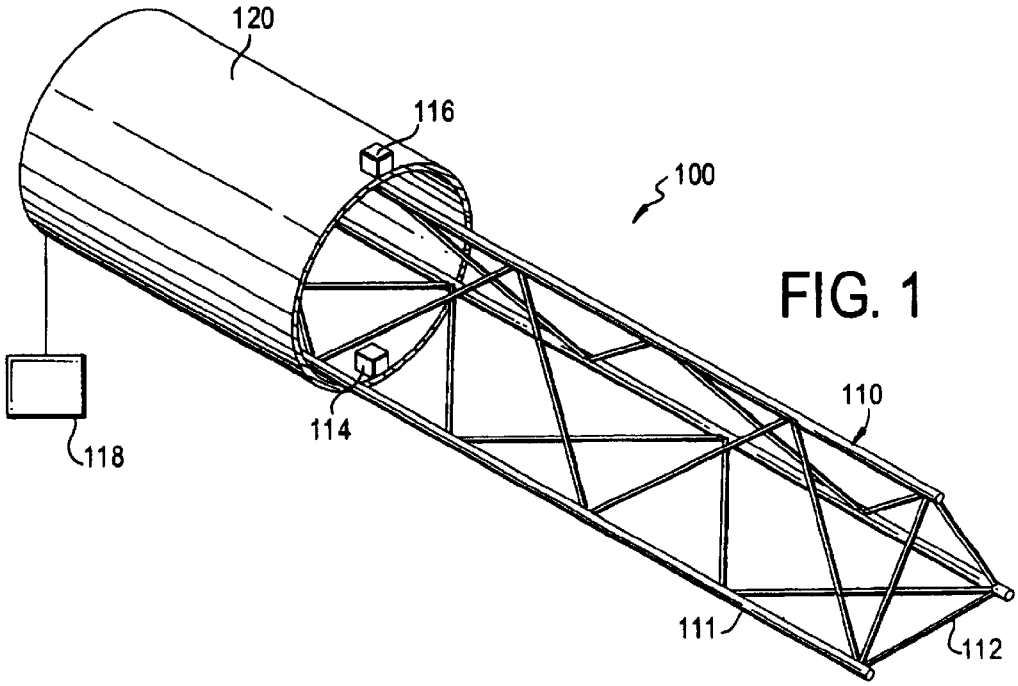
FIG. 1 is a partial perspective view of a space frame according to a first preferred embodiment of the present invention in which the shell and the frame assembly are in their deployed position.
Figure 2:
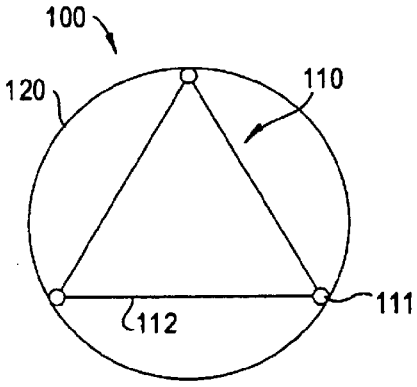
FIG. 2 is a cross-sectional view of the shell and the frame assembly depicted in FIG. 1.

Referring to FIGS. 1 and 2, a deployable space frame 100 constructed in accordance with a first preferred embodiment of the present invention is shown in its deployed position. In this embodiment, the space frame 100 comprises a packageable, deployable, and rigidizable frame assembly 110 having an assembly base end and an assembly tip end; a packageable, deployable, and inflatable frame assembly shell 120 disposed around the frame assembly, the shell having a shell base end and a shell tip end; means for attaching the frame assembly shell to the frame assembly; and a shell inflator (shown schematically at 118).

Frame assembly 110 comprises a plurality of connected thin-walled rigidizable composite struts which define a series of connected box frames, or bays, and has a polygonal cross-sectional shape (see FIG. 2). In the embodiment depicted in FIGS. 1 and 2, frame assembly 110 comprises first, second, and third longerons 111 extending from the assembly base end to the assembly tip end, and a plurality of connecting struts 112 interconnecting the first, second, and third longerons so as to form a triangular cross-sectional strut configuration.

Struts 111 and 112 can comprise various materials of construction and various shapes depending on the structural strength required. In a preferred embodiment, the struts are thin-walled composite laminate tubes of a thermosetting or thermoplastic material, with a wall thickness which is determined by the structural requirements of the specific application.

The means for attaching the frame assembly shell to the frame assembly serves to connect the struts 111 to the inside surface of the shell 120. These connections facilitate the proper packing and deployment of the shell as the frame assembly is packed and deployed. Suitable means for attaching the frame assembly shell to the frame assembly include tabs that are affixed to the inside surface of the shell and to the frame assembly. The tabs can be attached by means such as bonding and/or stitching.

The space frame properties are derived through the use of finite element beam modeling. Equivalent areas and moments of inertia are determined by applying unit loading to the finite element models, determining deflections and using standard structural mechanics equations to back calculate the properties. A geometrical configuration is determined such that the capacity of the space frame is approximately equal to the required compressive force. For example, in one application employing struts having a wall thickness of from 50 to 75 $\mu$m, and a diameter of from 0.64 to 1.27 cm, the frame assembly cross-sectional dimensions are such that the frame assembly cross section is capable of being inscribed within a 20.5 cm diameter circle.

Shell 120 is used for deployment, governs the deployed structure's straightness, and can provide some protection of the rigidized frame assembly elements from environmental degradation or thermal loads through the application of coatings, if required. The shell also provides the system's structure while in the inflated-only state. Often, this is the governing parameter in the system's design. The shell supports the loads from inflation and transfers those loads into the rigidizable space frame assembly to tension the members prior to rigidization.

The strength of the space frame during deployment is derived from the inflatable shell. Prior to rigidization, the inflatable shell governs the cross-sectional moment of inertia of the frame assembly, which makes it advantageous compared to other approaches such as an inflatable truss. Inflation of the shell yields a relatively high cross-sectional moment of inertia as compared to an inflatable truss because the moment of inertia is dependent on a cubic value of the radius. The larger radius of the inflatable portion of the space frame yields a relatively high stiffness during deployment as compared to a truss with small diameter inflatable members. Therefore, the shell provides the capability to withstand off-nominal loading during the deployment as well as during flight modes.

In a preferred embodiment, shell 120 comprises a polyimide film having a thickness of 12 $\mu$m, and in the embodiment depicted in FIGS. 1 and 2, has a substantially circular cross-sectional shape. Once the frame assembly is deployed and rigidized, the shell is depressurized and takes a passive role in system performance, apart from providing environmental resistance.

The shell inflator comprises a pressure-regulated gas source, such as nitrogen gas or a gas generated on board the spacecraft once on orbit, a plurality of redundant valves, a plurality of pressure sensors, and a plurality of pressure relief valves.

Figure 3:
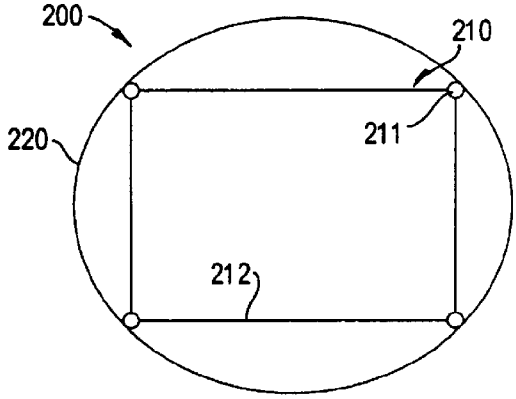
FIG. 3 is a cross-sectional view of the shell and the frame assembly according to a second preferred embodiment of the present invention.

Referring to FIG. 3, a deployable space frame 200 constructed in accordance with a second preferred embodiment of the present invention is shown in its deployed position. In this embodiment, frame assembly 210 comprises a plurality of connected thin-walled composite struts and has a polygonal cross-sectional shape. In the embodiment depicted in FIG. 3, frame assembly 210 comprises first, second, third, and fourth longerons 211 extending from the assembly base end to the assembly tip end, and a plurality of connecting struts 212 interconnecting the first, second, third, and fourth longerons so as to form a rectangular cross-sectional strut configuration.

The use of the term "shell" herein is meant to denote not only conduits such as the aforementioned shell having a substantially circular cross-sectional shape, but also includes all other cross-sectional shapes which are capable of being packaged and deployed according to the present invention. For example, the use of a rectangular cross-sectional strut configuration analogous to that depicted in FIG. 3 but in which the length of the rectangle is substantially greater than the width of the rectangle enables the approximation of a non-circular cross-sectional shell shape.

Figure 4:
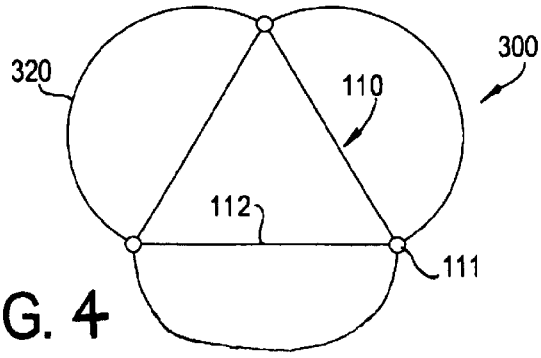
FIG. 4 is a cross-sectional view of the shell and the frame assembly according to a third preferred embodiment of the present invention.

Furthermore, as depicted in FIG. 4, a deployable space frame 300 constructed in accordance with a third preferred embodiment of the present invention comprises the same triangular cross-sectional strut configuration as the embodiment depicted in FIG. 2, but includes a shell 320 having a lobed cross-sectional shape. Additionally, even though the lobed cross-sectional shape embodiment has been depicted in conjunction with the triangular cross-sectional strut configuration, an analogous lobed cross-sectional shape could be employed with the rectangular cross-sectional strut configuration depicted in FIG. 3 (i.e., a shell having a lobe associated with each side of the rectangle). Finally, since, as indicated above, the frame assembly comprises a plurality of connected struts which define a polygonal cross-sectional shape, in the general case, a lobed cross-sectional shape can be employed in which the number of lobes is equal to the number of sides of the polygon.

The method of packaging and deploying a space frame 100, 200, or 300 (referred to herein in the description of the method as 100 for the purpose of brevity) comprises the following series of steps. First, frame assembly 110 is collapsed from the assembly tip end to the assembly base end by packaging shell 120 from the shell tip end to the shell base end to provide a packaged frame assembly/shell. In a preferred embodiment, the packaging step is accomplished by rolling the frame assembly-containing shell from the shell tip end to the shell base end. In another possible embodiment, however, the frame assembly-containing shell could be folded from the shell tip end to the shell base end in an accordian-like fashion.

Once on orbit, frame assembly 110 and shell 120 are controllably deployed from the packaged frame assembly/shell by employing the shell inflator to introduce an inflation gas into shell 120 so as to inflate the shell while imparting a resistance to the shell to resist deployment such that the internal gas pressure required to continue deployment is sufficient to fully inflate that portion of the shell to which said gas has been introduced. The introduction of the gas is continued and the resistance to deployment is maintained until frame assembly 110 and shell 120 are deployed.

Once frame assembly 110 and shell 120 are deployed, the introduction of gas into the shell is terminated, the frame assembly is rigidized, and the shell is depressurized.

The method of packing the space frame minimizes volume and ensures deployment reliability. The packing method is also low in mass, utilizes flight proven technology, and provides the required protection of the system during launch vibration.

While the inflation system can take several forms, a preferred embodiment is bottled $N_2$ gas, or cold gas from an existing source on the spacecraft, in order to reduce system risks. The shell is pressurized by a regulated gas source that is fed to the appropriate chambers at the required rates and times via valves that are actuated by computer or by human intervention, such as by radio signal, etc. Redundant valves and pressure sensing transducers are employed in the system to reduce risk, and the shell is fitted with relief valves to prevent over-pressurization.

Regardless of which configuration of the frame assembly is being employed, successful operation of the space frame depends on maintaining the stiffness of the inflatable shell while the frame assembly and shell are being controllably deployed. To achieve a controlled deployment, it is necessary to incorporate sufficient resistance to deployment such that the internal pressure required to continue deployment is high enough to adequately stiffen the portion of the shell that has already deployed. That is, the rate of deployment is controlled by a balance of forces between the resistance of the controlled deployment device and the flow rate and pressure of the inflation gas. During deployment, the internal pressure in the shell must be maintained at a prescribed level in order to yield the required skin stress in the inflatable shell's wall to react to loads on the system. This provides for a slow, controlled deployment which minimizes the possibility of film stress and film surface rubbing.

The roll-up embodiment of the present invention, which causes the least damage to the stowed shell and produces the smoothest deployment, comprises the rolled inflatable shell with a means for imparting resistance to deployment, i.e., a means for controlling the rate of unrolling when the inflation gas is introduced. The two general classes of deployment control which can be used in the roll-up embodiment include: i) means embedded in either the interior or exterior wall of the shell itself, and ii) means mounted at the deploying end of the shell.

Examples of the means for imparting resistance to unrolling which are embedded in the shell wall itself and which provide for adhesion of the rolled-up exterior shell wall surfaces to one another include a pressure sensitive adhesive, and a hook-and-loop fastener tape such as "VELCRO" (shown schematically at 114 and 116). In each of these means, the rolled shell remains in its packed state until the inflation pressure overcomes the resistance provided by the means and initiates deployment.

In a first embodiment of the means for imparting resistance to unrolling, a pressure sensitive adhesive is affixed to the exterior of the shell in longitudinal strips disposed at the 10 and 2 o'clock positions around the circumference of the shell. The adhesive can be used to control deployment as well as assist in maintenance of the package shape during launch vibration. The separation strength of the rolled shell from the outer wall of the shell, which dictates the internal pressure, is determined by the adhesive peel strength and the width of the strips of adhesive. The peel strength of this adhesive is constant over a wide temperature range about the predicted deployment temperature. The adhesive comprises high molecular weight compounds having high vacuum stability and therefore low outgassing characteristics. This embodiment requires only a few grams per linear meter of adhesive, and represents the lowest mass approach possible.

In a second embodiment of the means for imparting resistance to unrolling, a plurality of hook-and-loop fasteners embedded in the exterior wall of the shell can be used to control deployment and assist in maintenance of the package shape. This is accomplished by adding four independent strips of hook-and-loop fastener to the shell's exterior: two strips of hook at the 10 and 2 o'clock positions, and two strips of loop at the 8 and 4 o'clock positions. The shell is then flattened and rolled about the 9 to 3 o'clock axis. When inflation gas is introduced, the shell expands, causing the hook on the top side of the shell to detach from the loop on the bottom side of the shell, thereby allowing the shell to unroll. By selecting various grades and widths of hook-and-loop fastener, resistance to unrolling can be predicted and controlled, thus yielding the internal pressure required to provide the specified shell stiffness.

An example of a means for imparting resistance mounted at the deploying end of the shell is a means for imparting mechanical torque. Such devices function by torque reaction of the rolled shell on the inflated portion of the shell in order to control deployment of the system. This means can be, for example, a frictional device or a ratchet mechanism, such as a means for imparting torque through plastic deformation of a wire or tape of material. Such devices are typically low in mass and are highly reliable, but result in added tip mass which is unacceptable with applications in which bending loads are expected to be encountered from satellite attitude/reaction control system loads.

Successful deployment of the space frame is also dependent upon the ability of the frame assembly struts to be collapsible for packaging, and then deployable to shape when the shell is inflated. The struts, therefore, comprise a thermoplastic shape memory composite material. The thermoplastic shape memory composite will return to its manufactured "set" shape when heated above the second order transition temperature. Cooling the material below its second order transition temperature will then cause the material to become rigid. This allows the struts to be collapsed and packaged and later deployed to their final frame assembly shape.

In a preferred embodiment, the struts comprise thermoplastic composite laminate material which rigidizes by cold rigidization. Other possible embodiments of the strut materials, however, include materials such as ultraviolet radiation rigidizable materials and chemically hardened structures.

The functionality of the rigidization technique dictates the process by which the frame assembly is deployed and rigidized. First, the packaged frame assembly is preheated either by the heat given off by the spacecraft, by solar radiant energy, or by small heaters embedded in the packed volume. The packaged frame assembly would have good conduction paths and would be essentially the same temperature throughout the package. The preheating is necessary to warm the composite material above its second order transition temperature and provide it with some flexibility so as to allow it to be deployed via the inflation of the shell. During deployment, that portion of the packaged frame assembly which has not yet been deployed is housed in a multilayer insulation ("MLI") cover throughout its deployment. The cover contains the heat in the packaged frame assembly during the slow inflation process, thus keeping it in its flexible state until fully deployed.

Once the frame assembly emerges from the MLI cover it begins to give off heat and harden. The composite material's cooling rate is dictated by the insulating capability of the shell and any insulation layers added to the struts themselves. The insulation could be in the form of vapor deposited aluminum ("VDA") coated polyimide, and can be tailored to release heat at any rate to give the frame assembly structural capability, beyond that of the shell, even before deployment is complete. The MLI cover also controls the fluctuations in the temperature of the inflation gas and thus minimizes the quantity required if the system passes in and out of eclipse.

Both the thermoplastic and ultraviolet curable (thermoset) materials have been demonstrated with success in the manufacture and laboratory test of 3 meter long, 15 cm diameter booms. Advantages of thermoplastic materials, however, include the low coefficient of thermal expansion of the composite, low outgassing, ease of manufacture, reversibility to facilitate multiple functional tests in lab ambient conditions, and lower complexity.

Numerous thermoplastic materials are possible as matrix resins for use in composite struts. These materials are selected based on their performance properties, processing and manufacturing capability, and service temperature in various environments. In a preferred embodiment, the material is a modified thermoset that mimics a thermoplastic. Its properties include ease of processing, mechanical properties, thermal performance (softening point>70° C. for lab ambient testing and thermal margin on orbit), low creep, and ability to function as a shape memory plastic.

The resin can be applied to various reinforcements such as graphite, "KEVLAR," glass and/or ceramic fiber, poly(p-phenylene-2,6-benzobisoxazole)("PBO"), which is a rigid-rod isotropic crystal polymer, and "VECTRAN." Various weave styles are available with the required sizing to ensure wetting of the fibers and adhesion of the matrix resin. Hybrid weaves may also be a potential method of improving the reinforcement's capability while still retaining all of the flexibility required for manufacture and packaging.

An advantage of the present space frame is that a thermoplastic material will have a relatively high modulus unless heated to a temperatures which causes it to become very soft. This is an important consideration during deployment of high aspect ratio frame assemblies because the micro-wrinkles developed on the inboard side of the roll of a rolled shell can be impossible to remove with inflation pressure if the material has any significant stiffness (modulus) during deployment. The result, if this were to occur, would be curved structures. This concern is mitigated in the frame assembly because the length delta of the wall of the individual rolled members is relatively low and the truss members are under greater relative tension than conventional cylindrical constant wall thickness booms. The fact that the rigidizable material is also a shape memory plastic that is programmed to return to its original shape also mitigates the risk of curved structures.

The present invention, therefore, by making possible the use of a variety of lightweight frame assemblies and devices for providing resistance to deployment, facilitates the deployment of a variety of lightweight space structures such as solar arrays, reflectors, sunshields, radars, antennas and concentrators. Although the invention's primary application is in the deployment of space structures, one skilled in the art can appreciate that the invention could be employed in other environments that require the deployment of a lightweight structure.

The advantages of the space frame are numerous. First, the space frame minimizes the potential for premature rigidization, both pre- and post-launch. Since the frame assembly is manufactured from thermoplastic materials, it is impossible to have premature rigidization prior to deployment. Heating of the package during ascent from free molecular heating during launch will only preheat the assembly and is very desirable. The space frame is covered with MLI locally as well as in the area over the rolled-up section to prevent premature heat loss and rigidization during deployment The area over the roll may also be covered with a high alpha/epsilon material, such as VDA-coated film, to promote the retention of heat during deployment. The cover would deploy to an area where it would allow the tip of the frame assembly to rigidize when the structure was fully deployed. Therefore, the potential for premature rigidization is extremely low.

Secondly, the space frame provides tolerance to increasingly hostile environments, in particular, increased thermal loads, radiation, and spacecraft-induced contamination, as well as insensitivity to close proximity to either warm or cold structures. Environmental protection of the frame assembly is provided by the resiliency of the rigidizable materials and the protective capability of the MLI that locally wraps the struts, or the shell that also acts as part of the insulation blanket.

Thirdly, the space frame minimizes stowage volume and accommodates stowage in different stowage shapes.

While only certain preferred embodiments of this invention have been shown and described by way of illustration, many modifications will occur to those skilled in the art and it is, therefore, desired that it be understood that it is intended herein to cover all such modifications that fall within the true spirit and scope of this invention.

For example, the space frame can be tailored to meet the structural requirements of a specific application. Each of these modifications has little effect on the manufacturing process and cost of the system because the manufacturing techniques can easily accommodate many changes. Several design variables of the space frame which can be altered to optimize the structural characteristics include, for example, tapering the shell diameter from base to tip; resizing bays by altering the length of the struts and interface locations to the longerons; altering the material (fiber type, fiber orientation, resin type) and thickness of the structural members; and changing the diameter of the structural members to effect the cross-sectional moment of inertia Optimization of the space frame design by changing materials, processing techniques or geometry will also result in reduced linear mass densities of the space frame. The resulting reductions in system mass would result in a reduction in spacecraft bus mass and/or spacecraft expendables.

By way of further example of modifications within the scope of this invention, while the frame assembly has been described as having either a triangular (FIGS. 1, 2, and 4) or a rectangular (FIG. 3) cross-sectional configuration, another embodiment could comprise any other polygonal configuration (effected by altering the number of longerons) capable of being packaged and deployed, and of providing the requisite structural support.

By way of further example of modifications within the scope of this invention, while the shell has been described as having a substantially circular cross-sectional shape in the first and second preferred embodiments, other embodiments could comprise other shapes capable of being packaged and deployed, and of accommodating the configuration of the frame assembly, such as, for example, the aforementioned lobed configuration of the third preferred embodiment.

By way of further example of modifications within the scope of this invention, while the space frame has been described in the context of a single straight frame, another embodiment could comprise a configuration in which a plurality of space frames are interconnected to provide a faceted torus or similar shape.

Another possible embodiment could comprise a configuration in which a plurality of space frames are interconnected to provide a larger truss assembly. In the truss embodiment, the space frame comprises a plurality of packageable, deployable, and rigidizable frame assemblies, each of the assemblies having an assembly first end and an assembly second end; a plurality of packageable, deployable, and inflatable frame assembly shells each corresponding to each of the plurality of frame assemblies, each of the shells disposed around each of the corresponding frame assemblies, and each of the shells having a shell first end and a shell second end; means for attaching each of said shells to a corresponding one of each of said frame assemblies; means for connecting said assembly second end to said assembly first end for each of said plurality of frame assemblies, and means for connecting said shell second end to said shell first end for each of said plurality of shells; and a shell inflator for inflating the plurality of shells.

What is claimed is:

1. A method of packaging and deploying a space frame, said space frame comprising (i) a packageable, deployable, and rigidizable frame assembly, said frame assembly comprising a plurality of connected struts and having an assembly base end and an assembly tip end; (ii) a packageable, deployable, and inflatable frame assembly shell disposed around said frame assembly, said shell having a shell base end and a shell tip end; (iii) means for attaching said frame assembly shell to said frame assembly; and (iv) a shell inflator, said method comprising:

(a) collapsing said struts of said frame assembly from said assembly tip end to said assembly base end by packaging said shell from said shell tip end to said shell base end to provide a packaged frame assembly/shell;

(b) controllably deploying said frame assembly and said shell from said packaged frame assembly/shell by employing said shell inflator to introduce an inflation gas into said shell so as to inflate said shell while imparting a resistance to said shell to resist deployment such that an internal gas pressure required to continue deployment is sufficient to fully inflate that portion of the shell to which said gas has been introduced;

(c) continuing to resist said deployment until said frame assembly and said shell are deployed;

(d) terminating the introduction of said gas into said shell;

(e) rigidizing said frame assembly; and (f) depressurizing said shell.

2. A method of packaging and deploying a space frame according to claim 1, wherein said step (a) packaging is accomplished by rolling.

3. A method of packaging and deploying a space frame according to claim 1, wherein said step (a) packaging is accomplished by folding.

4. A method of packaging and deploying a space frame according to claim 1, wherein at least said steps (b), (c), and (d) are conducted outside the atmosphere of the earth.

* * * * *